United States Patent [19]

Grecco

[11] Patent Number: 4,971,375

[45] Date of Patent: Nov. 20, 1990

[54] RETROFIT LEVER HANDLE USED BY A DISABLED PERSON FOR TURNING A DOOR KNOB

[76] Inventor: Pasquale Grecco, 37 16th St., Hicksville, N.Y. 11801

[21] Appl. No.: 467,013

[22] Filed: Jan. 18, 1990

[51] Int. Cl.[5] ..... E05C 21/00

[52] U.S. Cl. ..... 292/347; 292/336.3; 16/114 R; 16/121

[58] Field of Search ..... 16/114 R, 121; 292/348, 292/350, 347, 336.3, DIG. 2

[56] References Cited

U.S. PATENT DOCUMENTS 2,801,122 7/1957 Sutter ..... 16/114 R
4,397,489 8/1983 Lind ..... 16/114 R
4,504,087 3/1985 Pennington ..... 16/114 R
4,783,883 11/1988 Szalay ..... 16/114 R

*Primary Examiner*—Richard K. Seidel
*Assistant Examiner*—P. Lee
*Attorney, Agent, or Firm*—Michael I. Kroll

[57] ABSTRACT

A retrofit lever handle used by a disabled person for turning a door knob on a door is provided and consists of an inner member which fits into an outer member that has a curved arm and tab thereon. The inner member is adjustable to grip the door knob on the door so that any portion of the disabled person can make contact with the curved arm while the tab will prevent slippage off of the arm. Movement of the arm will turn the door knob thus enabling the disabled person to open and close the door.

2 Claims, 1 Drawing Sheet

Fig. 1
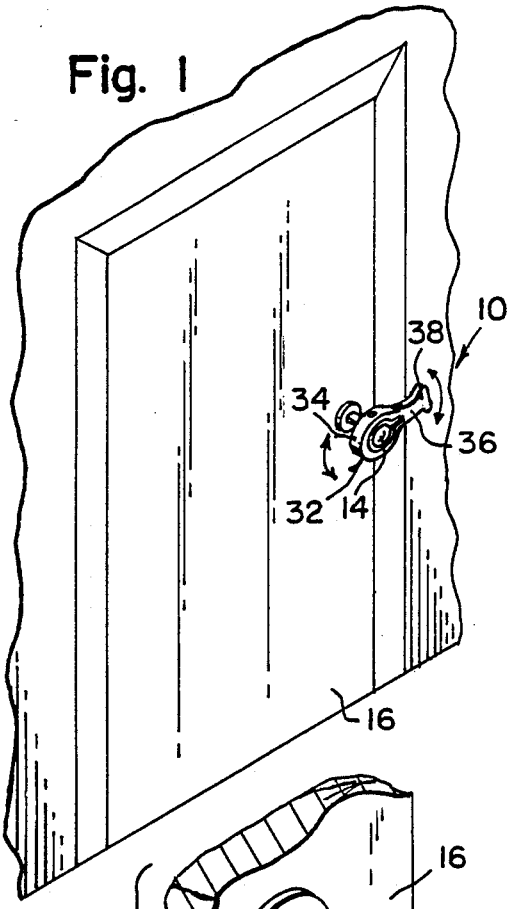
Fig. 5
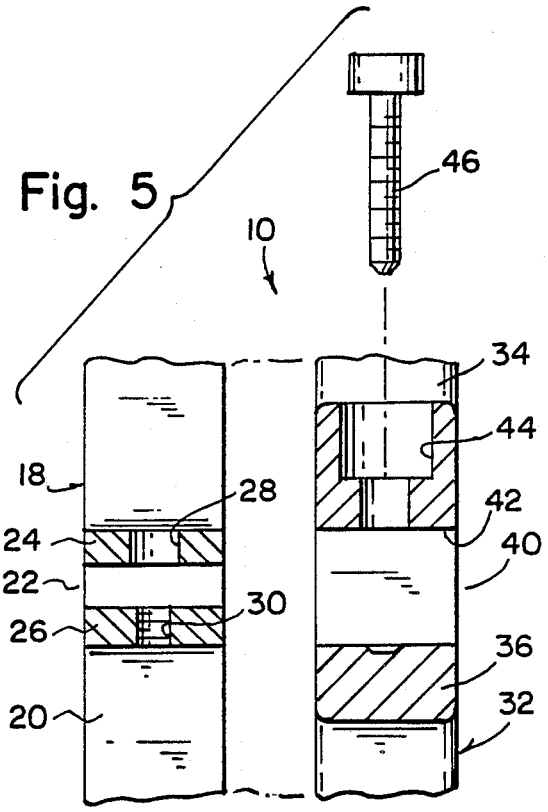
Fig. 2
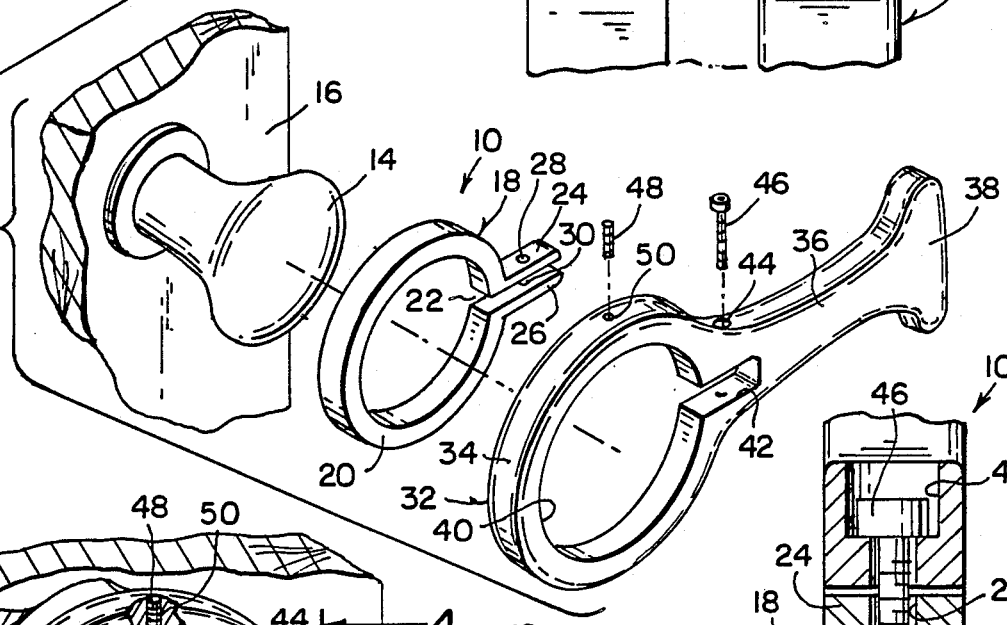
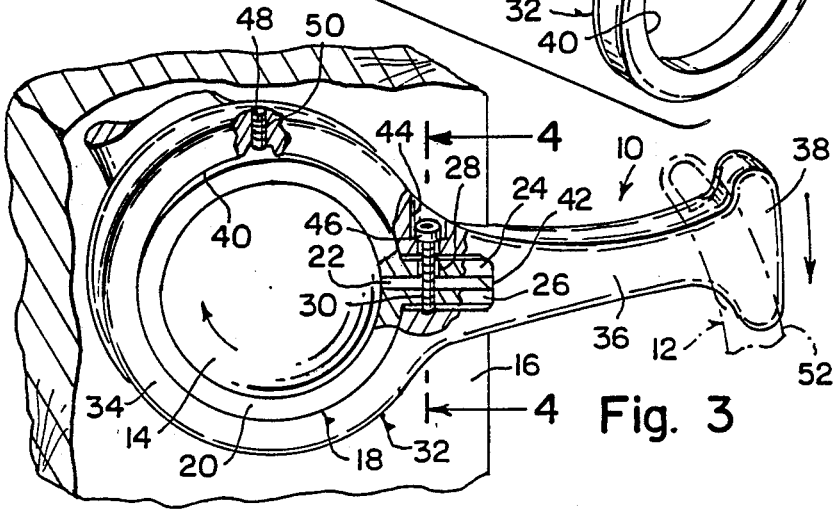
Fig. 3
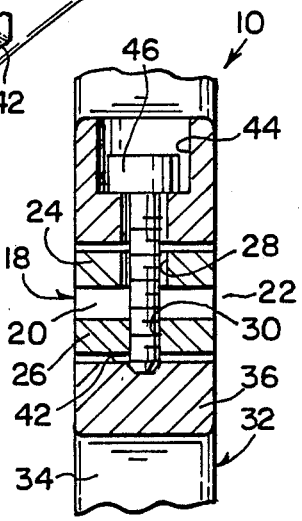
Fig. 4

RETROFIT LEVER HANDLE USED BY A DISABLED PERSON FOR TURNING A DOOR KNOB

BACKGROUND OF THE INVENTION

1. Field of the Invention

The instant invention relates generally to door knobs and more specifically it relates to a retrofit lever handle used by a disabled person for turning a door knob.

2. Description of the Prior Art

Numerous door knobs have been provided in prior art that are adapted to be gripped by the hand of a person requires the person to turn their wrist right or left to operate the door knob. While these units may be suitable for the particular purpose to which they address, they would not be as suitable for the purposes of the present invention as heretofore described.

SUMMARY OF THE INVENTION

A primary object of the present invention is to provide a retrofit lever handle used by a disabled person for turning a door knob that will overcome the shortcomings of the prior art devices.

Another object is to provide a retrofit lever handle used by a disabled person for turning a door knob that will connect the door knob to convert it into a lever type handle system thus enabling the disabled person to open and close a door.

An additional object is to provide a retrofit lever handle used by a disabled person for turning a door knob that is simple to install and can be reversed for a right or a left handed disabled person.

A further object is to provide a retrofit lever handle used by a disabled person for turning a door knob that is simple and easy to use.

A still further object is to provide a retrofit lever handle used by a disabled person for turning a door knob that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a perspective view of a door and a door knob with the invention installed thereon.

FIG. 2 is an exploded perspective view of the invention removed from the door knob.

FIG. 3 is a perspective view of the invention with parts in section showing a finger of a disabled person operating it.

FIG. 4 is a cross sectional view taken along line 4—4 in FIG. 3, showing the allen head bolt in engagement therein.

FIG. 5 is an exploded cross sectional view similar to FIG. 4, showing the interrelationship of the parts.

DETAILED DESCRIPTION OF THE PREFERRED EMBODIMENTS

Turning now descriptively to the drawings, in which similar reference characters denote similar elements throughout the several views, FIGS. 1 through 5 illustrate a retrofit lever handle 10 used by a disabled person 12 for turning a door knob 14 on a door 16 consisting of an inner member 18 having a first ring portion 20 with a transverse split 22 thereacross and a pair of outwardly extending generally parallel flanges 24 and 26, each formed on one side of the transverse split 22. The first flange 24 has a clearance hole 28 therethrough, while the second flange 26 has a threaded hole 30 therethrough in alignment with the clearance hole 28.

An outer member 32 has a second ring portion 34 with a curved arm 36 formed and extending from one side thereof and a tab 38 formed on the free end of the arm 36. The second ring portion 34 has a large aperture 40 therethrough with a slot 42 partially extending into the arm 36, which are sized to receive the first ring portion 20 with the flanges 24 and 26 of the inner member 18. The arm 36 has a transverse countersunk clearance hole 44 therethrough in alignment with the clearance hole 28 in the first flange 24 when the first ring portion 20 and the flanges 24 and 26 are inserted into the large aperture 40 and slot 42.

A tempered allen head bolt 46 enters the transverse countersunk clearance hole 44 in the arm 36, the clearance hole 28 in the first flange 24 and threads into the threaded hole 30 in the second flange 26 so that when the allen head bolt 46 is tightened the second flange 26 will move towards the first flange 18 to bear against the door knob 14 on the door 16. A set screw 48 is threaded into the second ring portion 34 of the outer member 32 at a threaded hole 50 to bear against the first ring portion 20 of the inner member 18 on the first flange 24 side. When the set screw 48 is tightened the first flange 4 will move towards the second flange 26 so that the first ring portion 20 of the inner member 18 will bear against the door knob 14 to fine tighten thereagainst. Any portion 52 of the disabled person 12, such as a finger or the like shown in phantom in FIG. 1, can make contact with the curved arm 36, while the tab 38 will prevent slippageg off of the arm 36. Movement of the arm 36 will turn the door knob 14 thus enabling the disabled person 12 to open and close the door 16.

The inner member 18 and the outer member 32 can be preferably fabricated out of light weight durable aluminum material but other types of durable material can also be used.

To use the retrofit lever handle 10 a person can simply fit the inner member 18 inserted and secured to the outer member 32 over the door knob 14. The allen head bolt 46 is then tightened to grip the door knob 14. The set screw 48 is now tightened to fine grip the door knob 14 to prevent slippage. The portion 52 of the disabled person 12 can make contact with the arm 36 and pull up or push down to turn the door knob 14 to open or close the door 16. The tab 38 will prevent the portion 52 from slipping off the arm 36.

LIST OF REFERENCE NUMBERS

10: retrofit lever handle
12: disabled person
14: door knob
16: door
18: inner member
20: first ring portion of 18
22: transverse split in 20
24: first flange on 20
26: second flange on 20

28: clearance hole in 24
30: threaded hole in 26
32: outer member
34: second ring portion of 32
36: curved arm on 32
38: tab on 36
40: large aperture in 34
42: slot into 36
44: countersunk clearance hole in 36
46: tempered allen head bolt
48: set screw
50: threaded hole in 34
52: any portion of 12

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A retrofit lever handle used by a disabled person for turning a door knob on a door comprising:

(a) an inner member having first ring portion with a transverse split thereacross and a pair of outwardly extending generally parallel flanges, each formed on one side of the transverse split, the first flange having a clearance hole therethrough, while the second flange having a threaded hole therethrough in alignment with the clearance hole;

(b) an outer member having a second ring portion with a curved arm formed and extending from one side thereof and a tab formed on the free end of the arm, the second ring portion having a large aperture therethrough with a slot partially extending into the arm, which are sized to receive said first ring portion with the flanges of said inner member, the arm having a transverse countersunk clearance hole therethrough in alignment with the clearance hole in the first flange when the first ring portion and the flanges are inserted into the large aperture and the slot;

(c) a tempered allen head bolt which enters the transverse countersunk clearance hole in the arm, the clearance hole in the first flange and threads into the threaded hole in the second flange so that when said allen head bolt is tightened the second flange will move towards the first flange to bear against the door knob on the door; and (d) a set screw threaded into the second ring portion of said outer member to bear against the first ring portion of said inner member on the first flange side, when said set screw is tightened the first flange will move towards the second flange so that the first ring portion of said inner member will bear against the door knob to fine tighten thereagainst, whereby any portion of the disabled person, can make contact with the curved arm, while the tab will prevent slippage off of the arm, in which movement of the arm will turn the door knob thus enabling the disabled person to open and close the door.

2. A retrofit lever handle as recited in claim 1, wherein said inner member and said outer member are fabricated out of a light weight durable aluminum material.

* * * * *